US006745966B2

(12) United States Patent
Heukamp

(10) Patent No.: US 6,745,966 B2
(45) Date of Patent: Jun. 8, 2004

(54) IMPACT MILL WITH PIVOTABLE IMPACT APRON

(75) Inventor: Volker Heukamp, Lengerich (DE)

(73) Assignee: Hazemag & EPR GmbH, Duelmen (DE)

( * ) Notice: Subject to any disclaimer, the term of this patent is extended or adjusted under 35 U.S.C. 154(b) by 0 days.

(21) Appl. No.: 10/096,888

(22) Filed: Mar. 13, 2002

(65) Prior Publication Data

US 2002/0139880 A1 Oct. 3, 2002

(30) Foreign Application Priority Data

Mar. 17, 2001 (DE) ..... 101 12 959

(51) Int. Cl.[7] ..... B02C 13/282
(52) U.S. Cl. ..... 241/189.1; 241/285.3
(58) Field of Search ..... 241/189.1, 285.3, 241/287, 288

(56) References Cited

U.S. PATENT DOCUMENTS 3,343,800 A * 9/1967 Rasmussen ..... 241/47
3,480,214 A * 11/1969 Wageneder ..... 241/189.1
5,213,273 A * 5/1993 Linnerz ..... 241/73
5,435,050 A * 7/1995 Alt ..... 29/402.03
5,472,147 A * 12/1995 Doppstadt ..... 241/88.4
5,890,666 A * 4/1999 Folling et al. ..... 241/189.1

FOREIGN PATENT DOCUMENTS

| | | |
|---|---|---|
| DE | 1 607 456 | 12/1969 |
| DE | 39 11 086 C2 | 10/1994 |
| DE | 43 11 435 A1 | 10/1994 |
| DE | 43 12 509 A1 | 10/1994 |

* cited by examiner

*Primary Examiner*—Allen Ostrager
*Assistant Examiner*—J Nguyen
(74) *Attorney, Agent, or Firm*—Michael J. Striker

(57) ABSTRACT

An impact mill has at least one rotor fitted with blow bars rotatably mounted in a mill housing and acting together with at least one impact apron, said at least one impact apron pivotably arranged in the mill housing via a pivot axle and infinitely adjustable by means of a linear drive, whereby an end of the at least one impact apron to that of the pivot axle is adjustable in relation to the rotor, and whereby the linear drive is mounted on a cover plate of the mill housing and is pivotably connected to the at least one impact apron at a distance from the pivot axis, wherein the linear drive is horizontally arranged approximately parallel to the cover plate of the mill housing and acts on a single lever passing through the cover plate of the mill housing, and wherein said single lever is firmly connected with the at least one impact apron and together with the at least one impact apron is pivotable about the pivot axle.

5 Claims, 2 Drawing Sheets

IMPACT MILL WITH PIVOTABLE IMPACT APRON

BACKGROUND OF THE INVENTION

The present invention relates to an impact mill with at least one rotor fitted with blow bars that is rotatably mounted in a mill housing and that acts together with at least one impact apron, which is pivotably arranged in the mill housing. The impact apron is infinitely adjustable by means of a linear drive, such as a hydraulic cylinder piston unit, so that the end of the impact apron opposite to that of the pivot axle is adjustable vis a vis the rotor, and whereby the linear drive is mounted on a cover plate of the mill housing and is pivotably connected to the impact apron at a distance from the pivot axle.

Such an impact mill—also called an impact crusher—is known from DE 39 11 086 A1. In this case, the linear drives are designed as hydraulic cylinders mounted upright on the cover plate of the mill housing, the extended piston rods of which project into the inside of the impact mill and are each connected to the impact aprons by means of clevis and bolt. The hydraulic cylinders are arranged approximately at right-angles to the longitudinal axes of the impact aprons, whereby the angle of the sloping cover plate is approximately parallel to the longitudinal axes of the impact aprons, thus, the choice of an upright arrangement for the hydraulic cylinders.

In many cases, the impact aprons are also attached to the cover plate of the mill housing by mechanical spindles, which are aligned similar to those described above (DE 1 607 456 A1 and DE 43 12 509 A1).

The known impact apron drives or impact apron mounting systems are disadvantageous in that the linear drives protrude considerably beyond the impact mill housings and thus can lead to problems when installation space is restricted. In addition, the known linear drives are connected with the impact aprons inside the impact mill, making assembly work and any subsequent maintenance that necessitates the dismantling of the linear drives very difficult.

The aim of the present invention, therefore, is to propose an impact mill that no longer has these disadvantages, i.e., which has a lower silhouette and in which the linear drives for the impact aprons are connected to the impact aprons of the impact mill housing. This problem is solved in that the linear drive for each impact apron is arranged horizontally and approximately parallel to the cover plate of the impact mill housing and pivotably connected to a lever that passes through the cover plate of the mill housing and is firmly connected to the impact apron.

DE 43 12 509 A1 relates to an impact mill that has a common pivot-mounted swing axle for two impact aprons, hence, the distance between the feed material inlet chute and the front end of the impact apron. The feed material inlet openings is therefore of adjustable design, by means of which occasional material blockages can be eliminated. The swing-mounted axle provided for this feature is led through the side of the impact mill housing and features a lever on which acts a horizontally-arranged cylinder piston unit. Because of the lateral exit of the swing-mounted axle, the position of the cylinder piston unit is totally unproblematic and could also be of a suspended design. A part from that, the weight of the impact apron and the shocks from the impact of the crush material are absorbed by the swing-mounted axle, which means that the cylinder piston unit can be of relatively small design. This design does not affect the present invention, particularly since the actual impact apron mounting on the cover plate of the mill housing by means of an erectly arranged threaded spindle is effected according to the state of the art technology.

SUMMARY OF THE INVENTION

The invention avoids the resultant disadvantages and permits the connecting of the linear drive on the cover plate of the mill housing outside the latter. Particularly advantageous is for the lever to be of circular segment-shaped design with the center of the circle corresponding to the center of the pivot axle. In this case, the seal of the opening in the housing cover plate for the passage of the circular segment-shaped lever can be of particularly uncomplicated design.

Another advantage over the state of the art technology is if the lever is designed as an angular lever that passes in the shape of an arm through the cover plate of the mill housing. In this case, solely the seal in the cover plate also should have a moveable design. In both designs, it is irrelevant whether the cover plate of the mill housing has a horizontal or sloping design. However, it is practical for the fulcrum of the lever on which the linear drive acts, and thus the orientation of the effective leverage in relation to the swivel axis, to be chosen such that the linear drive acts approximately parallel to the chord, which is defined by the end positions of the pivot angle of the lever. Ideally, the direction of action lies thereby at a point halfway between the height of the circular segment described through the pivot connection points of the linear drive on the levers. For a skilled person, the position of the lever relative to the longitudinal alignment of the impact apron and in interdependence with the position of the cover plate of the mill housing is easy to fix from a design point of view.

The preferred choice of linear drive design is a hydraulic cylinder piston unit. The advantages of the invention still apply, however, if the linear drive is provided by a threaded spindle supported by means of springs against the cover plate of the mill housing, the spindle nuts of which are turnable using hand or power-driven tools.

An additional advantage in the design of the swing drive for the impact aprons according to the invention is provided in that the linear drive is braced against the cover plate in the longitudinal direction of the latter, so that the stiffening of the cover plate can be of a less expensive design. By connecting the linear drive pivotably to the impact apron outside of the mill housing, the linear drive and the associated coupling parts are no longer exposed to wear, a fact that can certainly be highlights as an advantageous feature.

DETAILED DESCRIPTION OF THE PREFERRED EMBODIMENTS

Figure 1:
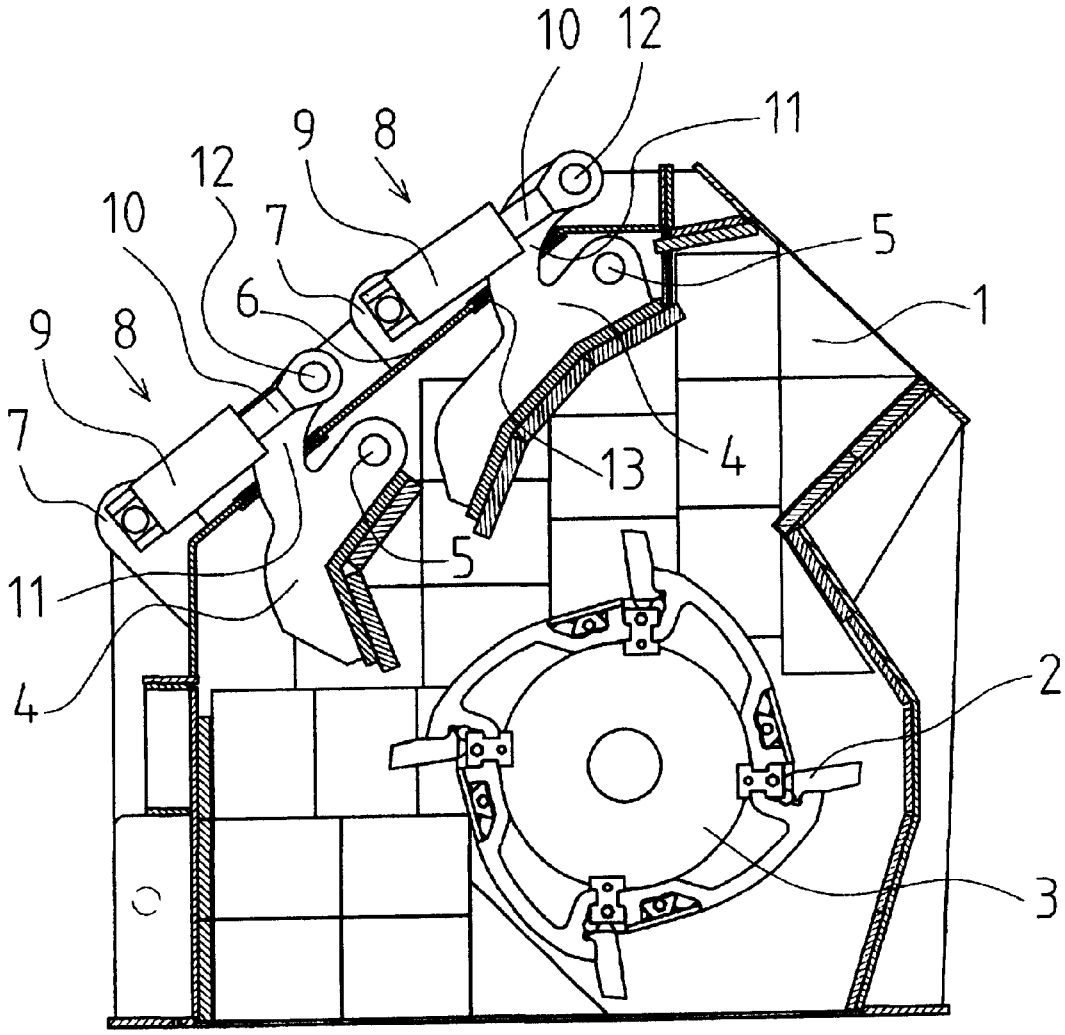
FIG. 1 shows a cross-section through an impact mill with an impact apron mounting according to the invention and with hydraulic cylinder piston units as a linear drive.

The impact mill features a mill housing 1, in which a rotor 3 fitted with blow bars 2 is rotatably arranged and which acts together with impact aprons 4 privotably arranged in the mill housing. The pivot axles are identified by the number 5. The mill housing is closed at the top by a sloping cover plate 6. The cover plate features mounting brackets 7, to which linear drives 8 are secured. As shown in FIG. 1, these each comprise a hydraulic cylinder piston unit 9, the piston rod 10 of which is pivotably connected to a circular segment-shaped lever 11 by means of a bolt connection 12. The circular segment-shaped lever is designed so that the center point of the circle corresponds to the pivot axle 5. Adjustment of the impact aprons 4 results in a punctuate position of the inner and outer sealing edges (circle section) on the circular segment, which allows use of a simple seal 13 at the opening in the housing cover plate 6.

Figure 2:
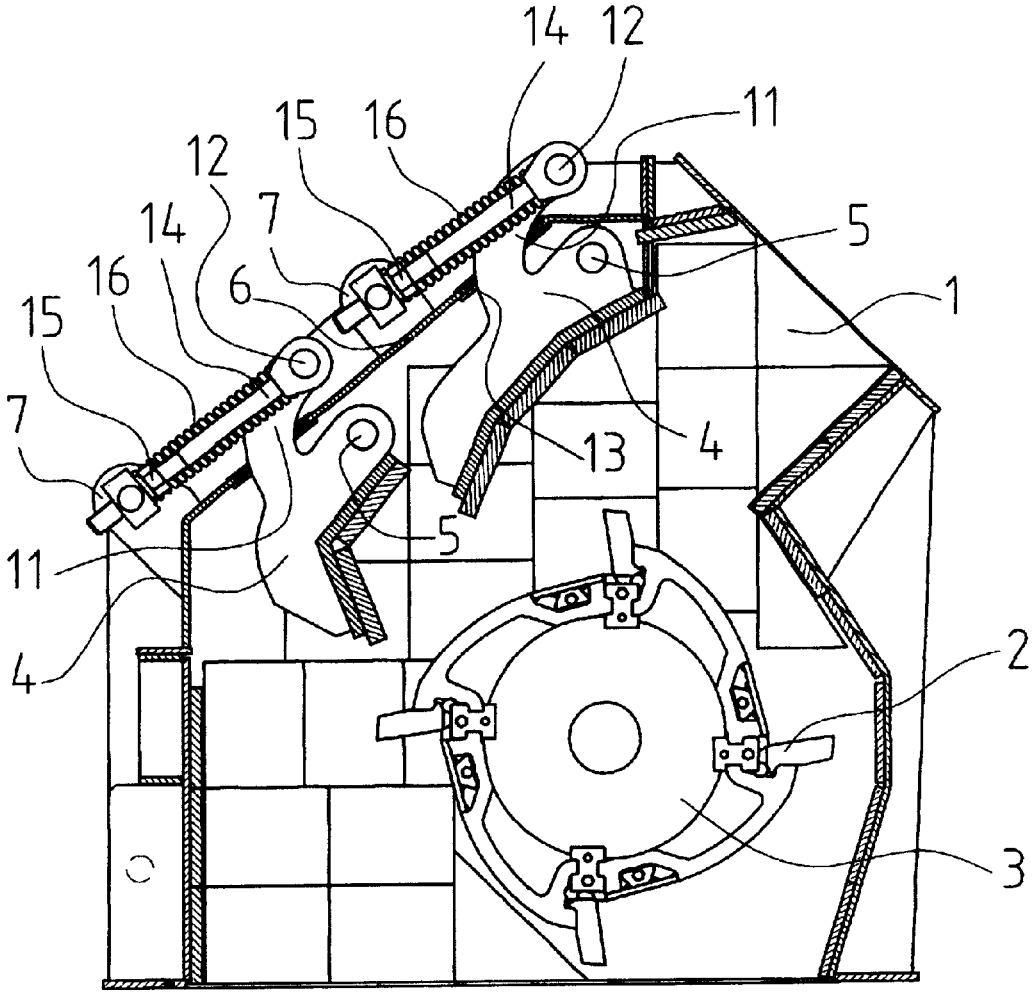
FIG. 2 shows, alternatively, the use of threaded spindles as a linear drive.

As shown in FIG. 2, the linear drives each comprise a mechanical drive featuring a threaded spindle 14 and a spindle nut 15. One or more springs 16 (spring pack) provide the necessary pressure of the impact aprons 4 onto the feed material to be comminuted, at the same time permitting retraction of the impact aprons when uncrushables enter the impact mill. The mechanical devices are designed so that they can be easily replaced by hydraulic cylinder piston units and vice versa.

It will be understood that each of the elements described above, or two or more together, may also find a useful application in other types of constructions differing from the types described above.

While the invention has been illustrated and described herein as an impact mill with a pivotable impact apron, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An impact mill, comprising:

at least one rotor fitted with blow bars rotatably mounted in a mill housing and acting together with at least one impact apron, said at least one impact apron pivotably arranged in the mill housing via a pivot axle and infinitely adjustable by means of a linear drive, whereby an end of the at least one impact apron to that of the pivot axle is adjustable in relation to the rotor, and whereby the linear drive is mounted on a cover plate of the mill housing and is pivotably connected to the at least one impact apron at a distance from the pivot axis, wherein the linear drive (8) is horizontally arranged approximately parallel to the cover plate (6) of the mill housing (1) and ads on a single lever (11) passing through the cover plate (6) of the mill housing, and wherein said single lever (11) is firmly connected with the at least one impact apron (4) and together with the at least one impact apron is pivotable about the pivot axle.

2. An impact mill according to claim 1, wherein the lever (11)is of circular segment-shaped design and has a center point corresponding to the pivot axle (5).

3. An impact mill according to claim 1, wherein the lever (11) is an angular lever and passes through the cover plate (6) of the mill housing.

4. An impact milling according to claim 1, wherein the linear drive (8) is a cylinder piston unit (9).

5. An impact mill according to claim 1, wherein the linear drive (8) is a threaded spindle (14) supported by means of the cover plate (6) of the mill housing (1) by springs (16), wherein said springs (16) have spindle nuts (15), and wherein said spindle nuts (15) are turned by hand or with a power tool.

* * * * *